US005765545A

United States Patent [19]

Ban et al.

[11] Patent Number: 5,765,545

[45] Date of Patent: Jun. 16, 1998

[54] VISCOUS FLUID TYPE HEAT GENERATOR WITH HEAT-GENERATION PERFORMANCE CHANGING UNIT

[75] Inventors: Takashi Ban; Hidefumi Mori; Kiyoshi Yagi; Tatsuya Hirose, all of Kariya, Japan

[73] Assignee: Kabushiki Kaisha Toyoda Jidoshokk Seisakusho, Kariya, Japan

[21] Appl. No.: 819,311

[22] Filed: Mar. 18, 1997

[30] Foreign Application Priority Data

Mar. 22, 1996 [JP] Japan ..... 8-066422

[51] Int. Cl.[6] ..... F24C 9/00

[52] U.S. Cl. ..... 126/247; 122/26

[58] Field of Search ..... 126/247; 122/26

[56] References Cited

U.S. PATENT DOCUMENTS

| | | | |
|---|---|---|---|
| 4,483,277 | 11/1984 | Perkins | 122/27 |
| 4,733,635 | 3/1988 | Menard et al. | 126/247 |
| 4,773,388 | 9/1988 | Herbulot et al. | 126/247 |

FOREIGN PATENT DOCUMENTS 752722 12/1995 Japan .

*Primary Examiner*—Carroll B. Dority
*Attorney, Agent, or Firm*—Burgess, Ryan & Wayne

[57] ABSTRACT

A viscous fluid type heat generator including a drive shaft for receiving a rotative drive force from an external drive source and mounting thereon a plurality of rotor elements to be rotated together with the drive shaft, a housing assembly in which at least one first heat generating component chamber confining therein a heat generative viscous fluid to which a shearing action is applied by the rotor elements, a second heat-generating-performance variable chamber confining a heat generative viscous fluid to which shearing action is applied by the rotor element, and a heat receiving chamber in which heat exchanging liquid flows therethrough to receive heat from the first and second heat generating chambers. The viscous fluid type heat generator further may includes a control chamber for controlling an amount of the viscous fluid in the second heat-generating-performance variable chamber, and a heat-generating-performance changing unit.

12 Claims, 4 Drawing Sheets

VISCOUS FLUID TYPE HEAT GENERATOR WITH HEAT-GENERATION PERFORMANCE CHANGING UNIT

BACKGROUND OF THE INVENTION

1. Field of the Invention

The present invention generally relates to a viscous fluid type heat generator in which heat is generated by forcibly shearing viscous fluid confined in a chamber and the heat is transmitted to a heat exchanging liquid circulating through a heating system. More particularly, the present invention relates to a viscous fluid type heat generator provided with a unit for changing heat-generation performance in response to a change in the heating requirement from an objective heated area.

2. Description of the Related Art

Japanese Examined Utility Model Publication No. 7-52722 (JU-B-7-52722) discloses a viscous fluid type heat generator adapted for being incorporated into an automobile heating system as a supplemental heat source. In the viscous fluid type heat generator of JU-B-7-52722, a plurality of partitioned heating chambers juxtaposed along an axis of a drive shaft are defined in the housing of the heat generator so as to confine therein a viscous fluid. The heat generator further includes a heat receiving chamber in the housing which permits a heat exchanging liquid to flow therethrough and to receive heat from the viscous fluid in the heating chamber. The heat exchanging liquid is circulated through the heat receiving chamber and a separate heating circuit of the automobile heating system so as to supply the heat to the objective area, e.g., a passenger compartment of the automobile during the operation of the heating system. Thus, the housing of the heat generator has an inlet port and an outlet port through which the heat exchanging liquid flows into and out of the heat receiving chamber.

The housing of the heat generator rotatably supports therein a drive shaft via anti-friction bearings so as to extend through the plurality of heating chambers. The drive shaft supports a plurality of rotor elements in a manner such that each of the rotor elements is rotatably arranged within each of the plurality of heating chambers. Thus, each of the rotor elements rotating within the corresponding heating chamber applies a shearing action to viscous fluid filled in gaps defined between the wall surface of the heating chamber and the outer surface of the rotor element.

In the viscous fluid type heat generator incorporated in the automobile heating system, the drive shaft is engaged with and driven by the automobile engine so that the respective rotor elements mounted on the drive shaft are rotated within the respective heating chambers. Thus, the heat is generated in each of the heating chamber by the viscous fluid being subjected to a shearing action by the rotating rotor element. The generated heat is transmitted to the heat exchanging liquid, and is carried by the heat exchanging liquid to the heating circuit to heat an objective heated area of the automobile such as the passenger compartment.

Nevertheless, the requirements for heating of the objective areas of automobiles changes depend upon changes in conditions of use of the respective automobiles. Namely, a change in climatic and/or geographical conditions in which the automobiles are used greatly affects on the requirement for heating of the automobiles employing the viscous fluid type heat generator. For example, when the automobiles are used in a region having a moderate climatic condition, the heating system including therein a viscous fluid type heat generator is not required to have a large heating performance. On the contrary, when the automobiles are used in a region having a cold climatic condition, the heating system must exhibit a relatively high heating performance. Thus, the viscous fluid type heat generator of the heating system must exhibits variety of heating performances in response to changes in the climatic and geographical conditions under which the automobiles are driven.

In the viscous fluid type heat generator described in JU-B-7-52722, the respective rotor elements have an identical diameter and width arranged in the respective heating chambers having an identical size. Therefore, in accordance with the design principle of the viscous fluid type heat generator described in JU-B-7-52722, the number of the rotor elements and the heating chambers of each viscous fluid type heat generator must be changed depending upon a change in a requirement for the heating performance exhibited by the heat generator. Accordingly, it is impossible to design and manufacture viscous fluid type heat generators uniform in size and capable of exhibiting a variety of heating performances in order to satisfy every kind of heating requirement. As a result, the manufacturing cost of the viscous fluid type heat generator must increase because common uniform parts and elements cannot be employed.

SUMMARY OF THE INVENTION

An object of the present invention is to eliminate defects encountered by the above described conventional viscous fluid type heat generator.

Another object of the present invention is to provide a viscous fluid type heat generator accommodating therein a unit for changing heating performance to satisfy every kind of heating requirement when the heat generator is incorporated in a heating system.

A further object of the present invention is to provide a viscous fluid type heat generator uniform in size and capable of exhibiting a variety of heating performances so as to be able to reply to a variety of heating requirements.

In accordance with the present invention, there is provided a viscous fluid type heat generator comprising:

a housing assembly defining therein a heat generating chamber for permitting heat to be generated therein and a heat receiving chamber arranged adjacent to the heat generating chamber for permitting a heat exchanging fluid to circulate therethrough to thereby receive heat from the heat generating chamber;

a drive shaft supported, via a bearing device, by the housing assembly to be rotatable about an axis of rotation thereof;

at least one partition plate dividing the heat generating chamber into at least two separate heat generating component chambers juxtaposed in a direction parallel with the axis of rotation of the drive shaft, each of the heat generating component chambers having an inner wall thereof;

at least two rotor elements coaxially mounted on the drive shaft for rotation together therewith, each of the rotor elements being arranged in each of the heat generating component chambers of the heat generating chamber and having outer faces defining spaces between the outer faces of each rotor element and the inner wall of each heat generating component chamber;

a viscous fluid confined in the spaces between the outer faces of said each rotor element and the inner wall of each heat generating component chamber so as to be subjected to shearing action generating the heat therein during the rotation of each rotor element, at least the two rotor elements being made different in size from one another to thereby exhibit different heat-generating-performance.

With the above-mentioned viscous fluid type heat generator, the heat generating performance of the heat generator can be varied by adjustably changing a combination of the plurality of rotor elements which are different in size without changing the size of the housing assembly, the drive shaft, and the other miscellaneous parts of the viscous fluid type heat generator except for the rotor elements. Therefore, many constructive elements and parts of the heat generator can be commonly used for assembling the viscous fluid type heat generators exhibiting different heat generating performances.

Preferably, the respective rotor elements mounted coaxially on said drive shaft may have outer diameters different from one another so that the pair of opposite outer faces of the respective rotor elements apply, to the viscous fluid in the respective heat generating component chambers, shearing actions different from one another.

Further preferably, the respective rotor elements mounted coaxially on said drive shaft may have axial widths different from one another so that the respective rotor elements apply, to the viscous fluid in the respective heat generating component chambers, shearing actions different from one another.

Still further preferably, one of the at least two separate heat generating component chambers is formed as a heat-generating-performance variable chamber, the heat-generating-performance variable chamber being provided with a heat-generating-performance changing unit including a control chamber arranged adjacent to the heat-generating-performance variable chamber and fluidly communicating with a central region of the heat-generating-performance variable chamber so as to receive a given amount of the viscous fluid from the heat-generating-performance variable chamber under the Weissenberg Effect when the heat-generating-performance of the viscous fluid type heat generator should be reduced. The control chamber further communicates with the heat-generating-performance variable chamber so as to supply the given amount of the viscous fluid therefrom into the heat-generation variable chamber.

The Weissenberg Effect is known in the field of the fluid dynamics as a kind of change in a normal stress of a non-Newtonian fluid, and according to the Effect, the non-Newtonian viscous fluid collects toward the center of rotation against a centrifugal force applied by a rotating element.

The heat-generating-performance changing unit may further include a thermo-sensitive actuating mechanism for controlling a fluid communication between the heat-generating-performance variable chamber and the control chamber in response to a change in the temperature of the viscous fluid within the control chamber from a predetermined reference temperature.

Preferably, the thermo-sensitive actuating mechanism comprises a bimetal-actuated rotary valve which controls the fluid communication between the heat-generating-performance variable chamber and the control chamber.

Preferably, the rotor element arranged within the heat-generating-performance variable chamber has a diameter smaller than that of the rotor element arranged within the other heat generating component chamber.

BRIEF DESCRIPTION OF THE DRAWINGS

The above and other objects, features and advantages of the present invention will be made more apparent from the ensuing description of preferred embodiments thereof with reference to the accompanying drawings wherein.

DESCRIPTION OF THE PREFERRED EMBODIMENTS

Figure 1:
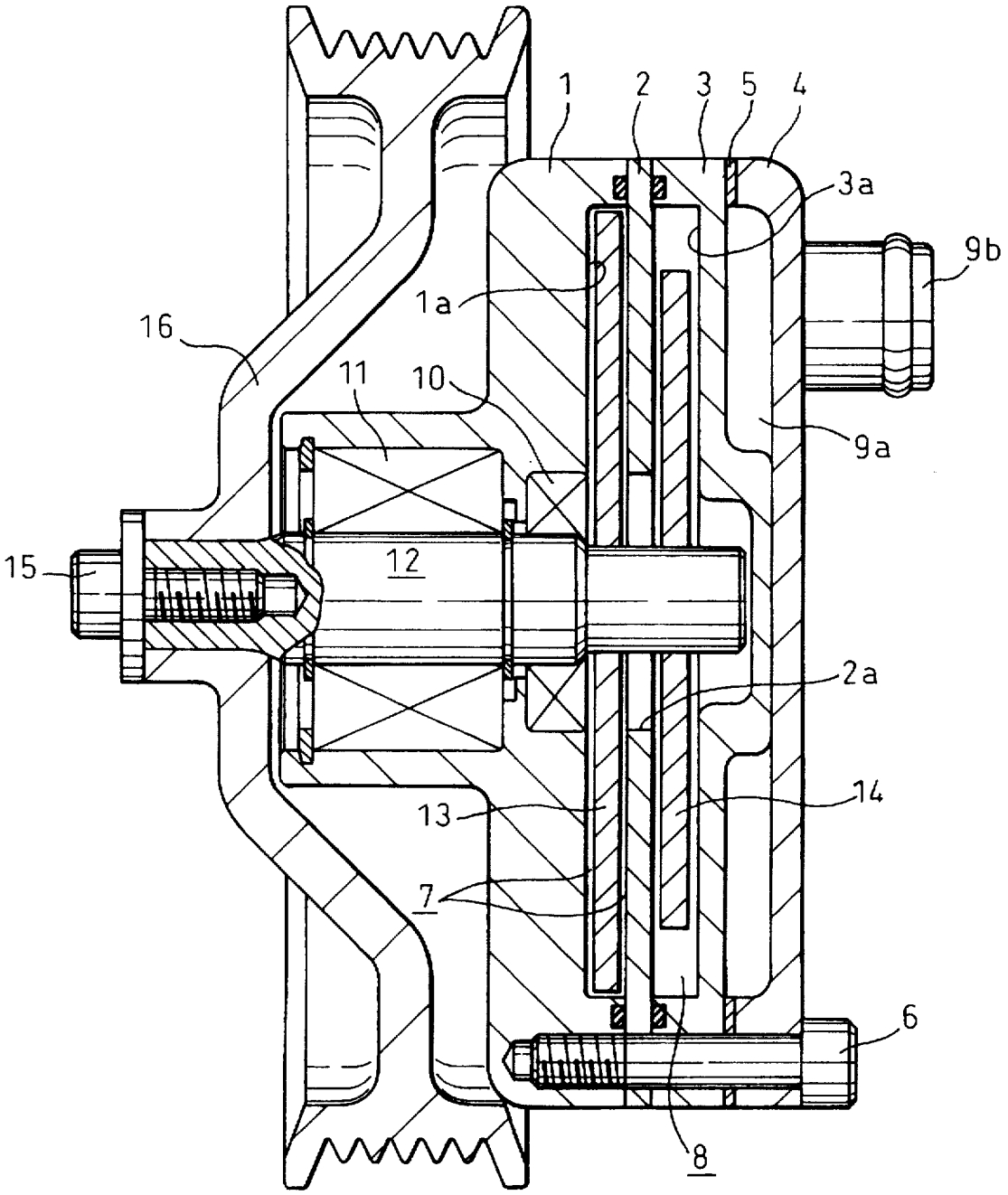
FIG. 1 is a longitudinal cross-sectional view of a viscous fluid type heat generator according to a first embodiment of the present invention.

Referring to FIG. 1, a viscous fluid type heat generator has a housing assembly including a front housing body 1, a first intermediate plate 2, a second intermediate plate 3, and a rear housing body 4 combined together by a plurality of long screw bolts 6. The housing assembly also has o-ring type seals between the front housing 1 and the first intermediate plate 2, and between the first and second intermediate plates 2 and 3, and further has a gasket 5 interposed between the second intermediate plate 3 and the rear housing body 4. The front housing body 1 has a circular inner recess la formed therein so as to define a first heat generating chamber 7 hermetically closed by one face of the first intermediate plate 2. The other face of the first intermediate plate 2 hermetically closes a second heat generating chamber 8 defined by a circular inner recess 3*a* formed in the inner face of the second intermediate plate 3. It will be understood that the first and second heat generating chambers 7 and 8 are arranged adjacent to one another so as to form coaxial chambers divided by the first intermediate plate 2, but fluidly communicate with one another via a central bore 2*a* of the first intermediate plate 2.

The housing assembly has a heat receiving chamber 9*a* which is defined between an outer face of the second intermediate plate 3 and an inner recessed face of the rear housing body 4, and is hermetically sealed by the gasket 5. The heat receiving chamber 9*a* which permits a heat exchanging liquid to flow therein is provided with an inlet port 9*b* and an adjacent outlet (not appearing in FIG. 1) formed in a part of the rear housing body 4. The inlet port 9*b* is provided for receiving the heat receiving liquid, and the outlet port is provided for delivering the heat exchanging liquid toward an external liquid conduit connected to a heating circuit of an external heating system (not shown) such as an automobile heating system.

The housing assembly has a shaft sealing device 10 arranged adjacent to the first heating chamber 7, and a boss portion defining a bearing chamber which receives therein an anti-friction bearing device 11 so as to rotatably support a drive shaft 12. The drive shaft 12 has an inner portion extending through the shaft sealing device 10 and through the first and second heat generating chambers 7 and 8 until the innermost end of the drive shaft 12 reaches an inner face of a recessed portion of the second intermediate plate 3. The inner portion of the drive shaft 12 rotatably supports thereon a first disk-like rotor element 13 arranged in the first heat generating chamber 7 and a second disk-like rotor element 14 arranged in the second heat generating chamber 8. It should be noted that the first and second rotor elements are produced as separate elements and are press-fitted on the drive shaft 12 at the stage of assembling the viscous fluid type heat generator so that the drive shaft 12 and the rotor elements 13 and 14 can rotate together. The diameter of the second rotor element 14 is intentionally made different from that of the first rotor element 13. Namely, the diameter of the second rotor element 14 is designed to be smaller than that of the first rotor element 13 in the present embodiment.

Within the first heat generating chamber 7, a preliminarily designed gaps are formed between the inner faces of the chamber 7 and the outer faces of the first rotor element 13, and filled up with viscous fluid consisting of e.g., silicone oil. Similarly, within the second heat generating chamber 8, identical gaps are formed between the surfaces of the chamber 8 extending perpendicularly to the axis of rotation of the second rotor element 14, and the surfaces of the second rotor element 14 perpendicular to the axis of rotation thereof, and filled up with the viscous fluid, e.g., silicone oil.

The drive shaft 12 has an outer portion extending beyond the housing assembly and mounting thereon a pulley 16 secured by a screw bolt 15. The pulley 16 can be connected to an automobile engine via a belt.

When the viscous fluid type heat generator is incorporated into an automobile heating system, and is driven by the automobile engine, the drive shaft 12 is rotated together with the first and second rotor elements 13 and 14. The first rotor element 13 rotating within the first heat generating chamber 7, and the second rotor element 14 rotating within the second heat generating chamber 8 apply shearing action to the viscous fluid confined in the spaces between the inner walls of the first and second heat generating chambers 7, 8 and the outer faces of the first and second rotor elements 13, 14, so that the viscous fluid generates heat.

When it is assumed that the coefficient of viscosity of the viscous fluid is "$\mu$", the radius of the first or second rotor element 13 or 14 is "R", an axial width of each of the first and second rotor elements 13 and 14 is "l", the axial extent of each space between the inner walls of the first and second heat generating chambers 7,8 and the outer faces of the first and second rotor elements 13, 14 is "$\delta$", and the angular speed of the respective rotor elements 13, 14 is "$\omega$", an amount of heat "$L_1$" generated by the viscous fluid held between the flat inner walls of the first and second heat generating chambers 7 and 8 and the flat outer faces of the two rotor elements 13 and 14 is defined by the following equation:

$$L_1=\pi\mu\omega R^4/\delta$$

Further, an amount of heat "$L_2$" generated by the viscous fluid held between the circular inner walls of the first and second heat generating chambers 7 and 8 and the circumferences of the two rotor elements 13 and 14 is defined by the following equation:

$$L_2=(2\pi\mu\omega R^3\times l)/\delta$$

Namely, the total amount of heat ($L_1+L_2$) is generated within the first and second heat generating chambers 7 and 8, and this heat is transmitted to the heat exchanging liquid, e.g., water flowing through the heat exchanging chamber 9*a* and circulating through the heating system. Thus, the heat exchanging liquid carries heat to the heating circuit of the heating system in order to warm and heat an objective region of an automobile to be heated, e.g., a passenger compartment.

At this stage, it should be understood that, under a condition that the first and second rotor elements 13 and 14 have an identical axial width "l ", when either both diameters of the rotor elements 13 and 14 or one of the diameters of the rotor elements 13 and 14 are changed, the shearing action applied by the rotating first and second rotor elements 13 and 14 to the viscous fluid confined within the first and second heat generating chambers 7 and 8 varies so as to result in causing a change in the total amount of heat ($L_1+L_2$) within the first and second heat generating chambers 7 and 8. Therefore, if a combination of the diameters of the first and second rotor elements 13 and 14 is adjustably and selectively changed at the stage of assembling the viscous fluid type heat generator, it is possible to adjustably control the total amount of heat ($L_1+L_2$) within the first and second heat generating chambers 7 and 8 depending on a requirement for heating of automobiles which is mainly determined by environmental and climatic conditions of various regions where the automobiles are practically used. Further, it should be noted that according to the concept of the first embodiment of the present invention, the size of the housing assembly including the front housing body 1, the first and second intermediate plates 2 and 3, and the rear housing body 4 does not need to be changed to change the heat-generating performance of the viscous fluid type heat generator of the first embodiment. Namely, it is only necessary to selectively change the combination of the diameters of the first and second rotor elements 13 and 14 for the viscous fluid type heat generator to vary its heat generating performance. Therefore, except for the first and second rotor elements 13 and 14, all of the elements and parts of the viscous fluid type heat generator can be made common for the production of heat generators having various kinds of heat generating functions. Thus, the production cost of each viscous fluid type heat generator can be appreciably reduced.

It should be appreciated that the viscous fluid type heat generator according to the described first embodiment of the present invention may be modified in such a manner that the pulley 16 is replaced with a known solenoid clutch device.

The second embodiment of the present invention will be described below with reference to FIG. 2.

Figure 2:
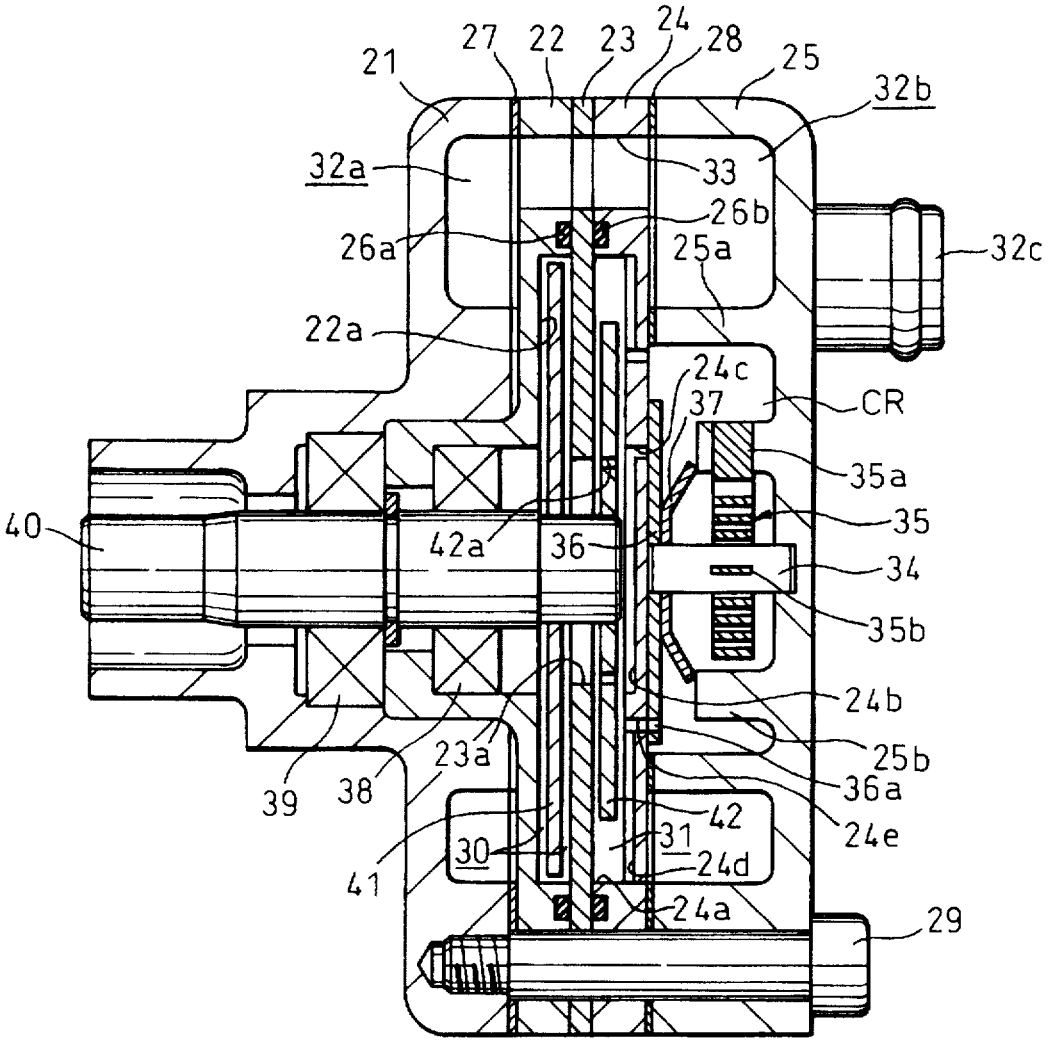
FIG. 2 is a longitudinal cross-sectional view of a viscous fluid type heat generator according to a second embodiment of the present invention.

As shown in FIG. 2, the viscous fluid type heat generator of the second embodiment is provided with a housing assembly including a front housing body 21, a first intermediate plate 22, a second intermediate plate 23, a third intermediate plate 24, and a rear housing body 25 combined together by a plurality of screw bolts 29. The housing assembly also includes an O-rings 26*a* arranged between the first and second intermediate plates 22 and 23, and an O-ring 26*b* arranged between the second and third intermediate plates 23 and 24. The housing assembly further includes a gasket element 27 arranged between the front housing body 21 and the first intermediate plate 22, and a gasket element 28 arranged between the third intermediate plate 24 and the rear housing body 25.

The first through third intermediate plates 22 through 24 of the housing assembly define a first heat generating chamber 30 and a second heat generating chamber 31. Namely, the first heat generating chamber 30 is formed by a circular recess 22*a* of the first intermediate plate 22 and one of opposite flat faces of the second intermediate plate 23, and the second heat generating chamber 31 is formed by the other of the opposite flat faces of the second intermediate plate 23 and a circular recess 24*a* of the third intermediate plate 24. The first and second heating chambers 30 and 31 are coaxial and communicate with one another via a central through-bore 23*a* of the second intermediate plate 23.

As described hereinafter, the second heat generating chamber 31 is characterized in that it is arranged as a chamber having a variable heat-generation performance and may be referred to as a heat-generation variable chamber. The heat-generation variable chamber 31 has a central fluid chamber 24b centrally recessed in a front inner face of the third intermediate plate 24. The central fluid chamber 24b is provided with a first fluid withdrawing hole 24c formed as a through-hole bored in the third intermediate plate 24 at a peripheral position of the central fluid chamber 24b.

The second heat generating chamber, i.e., the heat-generation variable chamber 31 is further provided with a fluid supply groove 24d formed in the third intermediate chamber 24 and radially extending from a lower portion of the central fluid chamber 24b toward a lower region of the heat-generation variable chamber 31. The radial fluid supply groove 24d communicates with a first fluid supply hole 24e axially bored through the third intermediate plate 24 at an inner portion of the radial fluid supply groove 24d.

It will be understood that the first and second heat generating chambers 30 and 31 are divided by the second intermediate plate 23 within the housing assembly so as to maintain a fluid communication therebetween via the central through-bore 23a of the second intermediate plate 23.

The housing assembly of the viscous fluid type heat generator of the second embodiment is also provided with a front heat receiving chamber 32a formed by an annular chamber recessed in an inner face of the front housing body 21 and closed by a front face of the second intermediate plate 22. The front heat receiving chamber 32a is arranged adjacent to the first heat generating chamber 30.

The housing assembly is further provided with a second heat receiving chamber 32b formed as an annular chamber defined between the third intermediate plate 24 and the rear housing body 25. Namely, the second heat receiving chamber 32b annularly extends between an outer circumference and an inner annular rib 25a of the rear housing body 25 and facing a rear inner face of the third intermediate plate 24, and is arranged adjacent to the second heat generating chamber 31. The second heat receiving chamber 32b has an inlet port 32c for permitting a heat exchanging liquid to flow into the second heat receiving chamber 32b therethrough, and an outlet port (shown in FIG. 2) for permitting the heat exchanging liquid to flow out of the second heat receiving chamber therethrough. The inlet port 32c and the outlet port are formed by two separate fluid conduits bored in the rear housing body 25.

The first and second heat receiving chambers 32a and 32b communicate with one another via a plurality of communication passageways 33 equi-angularly arranged in the first through third intermediate plates 22 through 24, and each of the communication passageways 33 is arranged between two neighboring bores for the screw bolts 29. Thus, the heat exchanging liquid flows through both the first and second heat receiving chambers 32a and 32b via the plurality of communication passageways 33, and receives heat from the first and second heat generating chambers 30 and 31.

The housing assembly of the viscous fluid type heat generator of the second embodiment is still further provided with a control chamber CR provided within the rear housing body 25 located radially inward with respect to the above-mentioned annular second heat receiving chamber 32b, and hermetically isolated from the chamber 32b by the annular rib 25a. The control chamber CR is arranged to fluidly communicate with the central fluid chamber 24b of the heat-generation variable chamber, i.e., the second heat generating chamber 31 via the first fluid withdrawing hole 24c, and with the first fluid supply hole 24e of the third intermediate plate 24.

The rear housing body 25 is provided with an annular projection 25b projecting from an inner face of the rear housing body 25 into the above-mentioned control chamber CR.

The viscous fluid type heat generator of this embodiment is also characterized in that it additionally has a heat-generating-performance changing unit which includes a valve shaft 34 rotatably held in the inner face of the rear housing body 25 at a central position of the control chamber CR, and enclosed by the annular projection 25b of the rear housing body 25. The valve shaft 34 is an axial element arranged at the center of the annular projection 25b and extending toward the third intermediate plate 24.

The heat-generating-performance changing unit is also provided with a thermo-sensitive actuating mechanism which includes a bimetal-coil-spring 35 having an outer end 35a fixed to a portion of the annular projection 25b and an inner end 35b fixed to the rotatable valve shaft 34. The bimetal-coil-spring 35 is provided so as to spirally move from a predetermined position set for a predetermined temperature which is set as a reference temperature for heating an objective heated area, e.g., a passenger compartment of an automobile, in response to a change in the temperature thereof from the predetermined temperature. The movement of the bimetal-coil-spring 35 causes a rotation of the valve shaft 34 to which a disk-like rotary valve 36 is secured so as to rotate with the valve shaft 34. The rotary valve 36 is urged toward the rear inner face of the third intermediate plate 24 by a disk spring 37 seated against an annular end of the annular projection 25b, so that the rotary valve 36 normally closes the first fluid withdrawing hole 24c and the first fluid supply hole 24e within the control chamber CR. The rotary vale 36 is provided with an arcuate fluid withdrawing slot (not shown in FIG. 2) for withdrawing the viscous fluid from the second heat generating chamber 31 into the control chamber CR, and an arcuate fluid supply slot 36a for supplying the viscous fluid from the control chamber CR into the second heat generating chamber 31. Namely, when the rotary valve 36 is rotated to a position where the arcuate fluid withdrawing slot is in registration with the first fluid withdrawing hole 24c, withdrawal of the viscous fluid from the second heat generating chamber 31 to the control chamber CR occurs, and when the rotary valve 36 is rotated to a position where the arcuate fluid supply slot 36a is in registration with the first fluid supply hole 24e, supply of the viscous fluid from the control chamber CR into the second heat generating chamber 31 occurs.

The viscous fluid type heat generator of the second embodiment is further provided with a shaft sealing device 38 positioned within a boss portion of the first intermediate plate 22 so as to be arranged adjacent to the first heat generating chamber 30, and an anti-friction bearing device 39 positioned within a boss portion of the front housing body 21. The shaft sealing device 38 and the anti-friction bearing device 39 rotatably support a drive shaft 40 having an axially inner portion extending into the first and second heat generating chambers 30 and 31. The axially inner portion of the drive shaft 40 supports thereon a flat-plate like first rotor element 41 arranged within the first heat generating chamber 30, and a second rotor element 42 arranged within the second heat generating chamber 31. The diameter of the second rotor element 42 is selected to be smaller than that of the first rotor element 41. Both rotor elements 41 and 42 are press-fitted on the drive shaft 40 to rotate together with the drive shaft 40. The second rotor element 42 is provided, at a central portion thereof, with a plurality of spaced through-holes 42a.

Within the first heat generating chamber 30, spaces are provided between the inner faces of the first heat generating chamber 30 and the outer faces of the first rotor element 41. Similarly, within the second heat generating chamber 31, spaces are provided between the inner faces of the second heat generating chamber 31 and the outer faces of the second rotor element 42. These spaces of the first and second heat generating chambers 30 and 31 are filled up with viscous fluid, e.g., silicone oil. The viscous fluid also fills the control chamber CR so that the bimetal-coil-spring 35 is immersed in the fluid at the initial stage of the assembly of the heat generator.

The drive shaft 40 of the viscous fluid type heat generator can be connected to a drive source, e.g., an automobile engine (not shown) via an appropriate transmission mechanism such as a belt-pulley mechanism or a solenoid clutch.

When the viscous fluid type heat generator of the second embodiment is incorporated into an automobile heating system, and is driven by the automobile engine, the drive shaft 40 is rotated together with the first and second rotor elements 41 and 42. The first rotor element 41 rotating within the first heat generating chamber 30, and the second rotor element 42 rotating within the second heat generating chamber 31 apply shearing action to the viscous fluid confined in the spaces between the inner walls of the first and second heat generating chambers 30, 31 and the outer faces of the first and second rotor elements 41, 42 so that the viscous fluid generates heat. The heat generated within the first and second heat generating chambers 30 and 31 is transmitted to the heat exchanging fluid flowing through the first and second heat receiving chambers **32*a* and 32*b***, so that the heat is carried to the external heating circuit of the automobile heating system in order to heat the objective heated area, i.e., the passenger compartment of an automobile.

During the operation of the viscous fluid type heat generator of the second embodiment, the viscous fluid (silicone oil) within the second heat generating chamber 31 generally collects toward the central portion of the chamber 31 due to the Weissenberg Effect. Thus, when the temperature of the silicone oil filling in the control chamber CR is lower than the predetermined reference temperature, the bimetal-coil-spring 35 stays at a position where the first fluid withdrawing hole **24*c* is not in registration with the arcuate fluid withdrawing slot of the rotary valve 36 but the first fluid supply hole 24*e* is in registration with the arcuate fluid supply slot 36*a* of the rotary valve 36. Therefore, the silicone oil within the second heat generating chamber 31 is not withdrawn from the central fluid chamber 24*b* into the control chamber CR. On the other hand, a supplementary amount of the silicone oil is supplied from the control chamber CR into the second heat generating chamber 31 through the arcuate fluid supply slot 36*a*, the first fluid supply hole 24*e*, and the radial fluid supply groove 24*d*. The supply of the silicone oil from the control chamber CR into the second heat generating chamber 31 is promoted by the provision of the aforementioned through-holes 42*a*. Namely, the through-holes 42*a* of the second rotor element 42 permit the silicone oil to smoothly flow from the space between the rear face of the second rotor element 42 and the inner face of the third intermediate plate 24 into the space between the front face of the second rotor element 42 and the inner face of the second intermediate plate 23**.

When the supplementary silicone oil is supplied from the control chamber CR into the second heat generating chamber 31, the heat generation within the second heating chamber 31, i.e., the heat-generation variable chamber increases. Therefore, the viscous fluid type heat generator increases its heat-generation performance, and accordingly, the automobile heating system can increase its heat output.

On the other hand, when the temperature of the silicone oil within the control chamber CR is higher than the predetermined reference temperature indicating that heat application by the automobile heating system to the heated area is in excess, the bimetal-coil-spring 35 rotates the rotary valve 36 to the position where the first fluid withdrawing hole **24*c* and the arcuate fluid withdrawing slot of the rotary valve 36 are in registration with one another, but the first fluid supply hole 24*e* of the second heat generating chamber 31 is not in registration with the arcuate fluid supply slot 36*a* of the rotary valve 36. Therefore, the viscous fluid, i.e., the silicone oil within the second heat generating chamber 31 is withdrawn from the chamber 31 into the control chamber CR through the central fluid chamber 24*b*, the first fluid supply hole 24*e*, and the arcuate fluid supply slot 36*a*. The through-holes 42*a* of the second rotor element 42 permit the silicone oil to smoothly collect within the central fluid chamber 24*b*, and in turn flow into the control chamber CR. Accordingly, the silicone oil is held within the control chamber CR without re-supplying into the second heat generating chamber 31. As a result, an amount of the silicone oil confined within the second heat generating chamber 31 in which the small diameter second rotor element 42 rotates is reduced, and accordingly, a reduction of heat-generation within the second heat generating chamber 31** appreciably occurs. Thus, the viscous fluid type heat generator can reduce its heat-generating performance so as to reduce the heating function of the automobile heating system.

It should be understood that the heat-generating-performance changing unit of the viscous fluid type heat generator of the second embodiment can be very effective for a quick withdrawal of the silicone oil from the second heat generating chamber 31 into the control chamber CR and for a quick supply of the silicone oil from the control chamber CR into the second heat generating chamber 31 in response to a change in requirement for heating function of the automobile heating system. Therefore, the automobile heating system incorporating therein the viscous fluid type heat generator according to the second embodiment can exhibit a high responsiveness in the heating function when the heating system is operated. Further, the provision of the second heat-generating performance variable chamber 31 is very effective for mitigating a mechanical shock given by the automobile engine.

The amount of the viscous fluid confined within the first heat generating chamber 30 can be kept unchanged by appropriately selecting the diameter of the central through-bore **23*a* of the second intermediate plate 23**.

In accordance with the viscous fluid type heat generator of the second embodiment of the present invention, it should be understood that, under a condition that the first and second rotor elements 41 and 42 have an identical axial width, when either both diameters of the rotor elements 41 and 42 or one of the diameters of the first and second rotor elements 41 and 42 are changed, the shearing action applied by the rotating first and second rotor elements 41 and 42 to the viscous fluid confined within the first and second heat generating chambers 30 and 31 varies so as to result in a change in the total amount of heat within the first and second heat generating chambers 30 and 31. Therefore, if a combination of the diameters of the first and second rotor elements 41 and 42 is adjustably and selectively changed at the stage of assembling the viscous fluid type heat generator of the second embodiment, it is possible to adjustably control the total amount of heat within the first and second heat generating chambers 30 and 31 depending on a requirement for heating of automobiles which is mainly determined by environmental and climatic conditions of various regions where the automobiles are practically used. Also, if only the diameter of the second rotor element 42 within the second heat generating chamber 31 is changed, it is possible to vary the heat-generating performance of the viscous fluid type heat generator of the second embodiment. Therefore, it will be understood that according to the concept of the second embodiment of the present invention, the size of the housing assembly including the front housing body 21, the first through third intermediate plates 22 through 24, and the rear housing body 25 does not need to be changed to change the heat-generating-performance of the heat generator. Namely, it is only necessary to selectively change the diameter of the first and second rotor elements 41 and 42 within the first heat generating chamber 30 and the heat-generating-performance variable chamber 31 for the viscous fluid type heat generator to vary its heat generating performance. Therefore, except for the first and second rotor elements 41 and 42, all of the elements and parts of the viscous fluid type heat generator can be made common for the production of heat generators having various kinds of heat generating functions. Thus, the production cost of the viscous fluid type heat generator of the second embodiment can be appreciably kept low.

Figure 3:
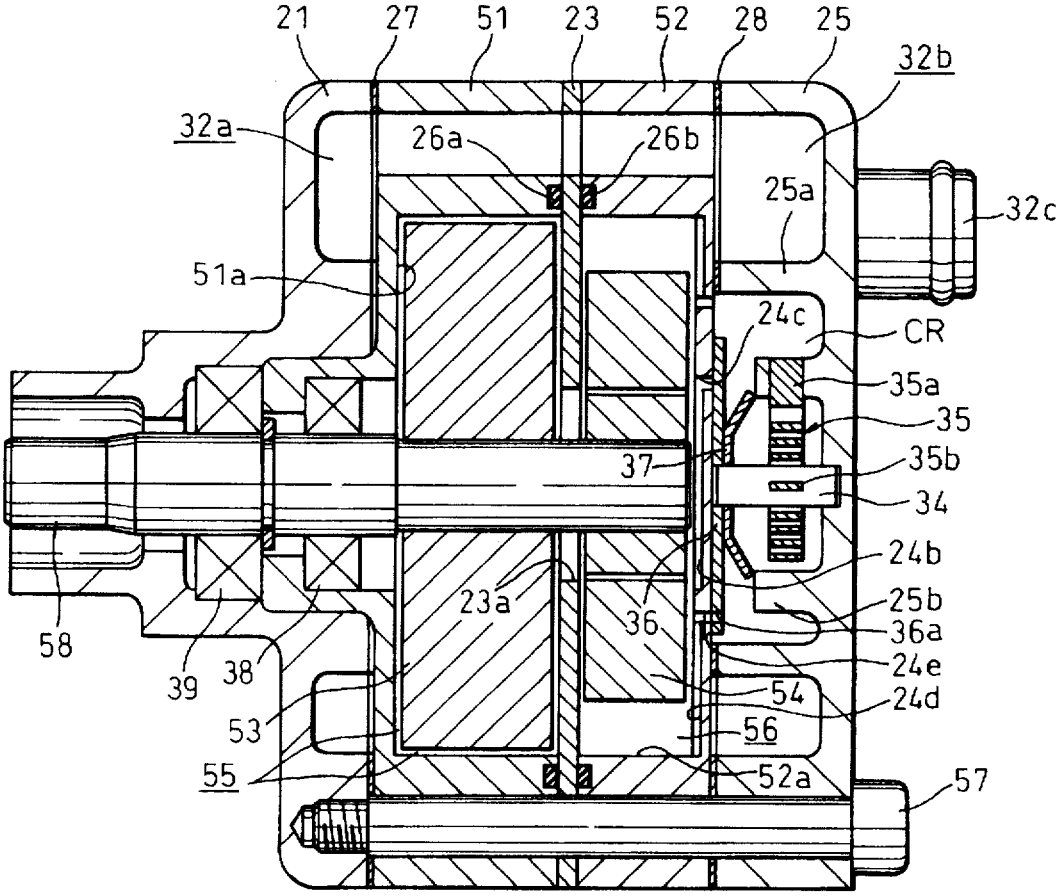
FIG. 3 is a longitudinal cross-sectional view of a viscous fluid type heat generator according to a third embodiment of the present invention.

FIG. 3 illustrates the viscous fluid type heat generator according to the third embodiment. As will be easily understood from FIG. 3, the heat generator of the third embodiment is different from the heat generator of the second embodiment in that the axial widths of the first and second heat generating chambers 55 and 56 are formed to be appreciably longer than those of the first and second heat generating chambers 30 and 31 of the second embodiment (FIG. 2). Therefore, the axial lengths of the first and third intermediate plates 51 and 52 are longer than those of the first and third intermediate plates 22 and 24 of the second embodiment. The first intermediate plate 51 is provided with an axially long recess 51*a* formed therein so as to define the axially wide first heat generating chamber 55. Similarly, the third intermediate plate 52 is provided with an axially long recess 52*a* formed therein so as to define the axially wide second heat generating chamber 56 which is formed as the heat-generating-performance variable chamber.

The first and second rotor elements 53 and 54 arranged within the first and second heat generating chambers 55 and 56 are formed to have a large axial width compared with the first and second rotor elements 41 and 42 of the second embodiment.

Further, the length of a plurality of screw bolts 57 for tightly combining the first housing body 21, the first through third intermediate plates 51, 23, and 52, and the rear housing body 25 of the housing assembly is longer than that of the screw bolts 29 of the second embodiment. Further, the axial length of a drive shaft 58 is formed to be longer than that of the drive shaft 40 of the second embodiment. The other parts and elements of the heat generator of the third embodiment are identical with those used in the heat generator of the second embodiment.

The viscous fluid type heat generator of the third embodiment employing the first and second rotor elements 53 and 54 having large axial widths is able to apply a large shearing force to the viscous fluid within the first and second heat generating chambers 55 and 56 compared with the heat generator of the second embodiment shown in FIG. 2. Further, since the viscous fluid type heat generator of the third embodiment incorporates therein the second heat generating chamber 56 formed as a heat-generating-performance variable chamber 56, and a heat-generating-performance changing unit including the bimetal-coil-spring 35 and the rotary valve 36 which are similar to those of the heat generator of the second embodiment, the heat generator of the third embodiment can exhibit variable heat-generating-performance in response to a change in a requirement for heating function of the automobile heating system. It should be noted that the concept of the third embodiment of the present invention employing a various combination of the first and second rotor elements 53 and 54 having large axial widths can contribute to lowering the production cost of the viscous fluid type heat generator.

Figure 4:
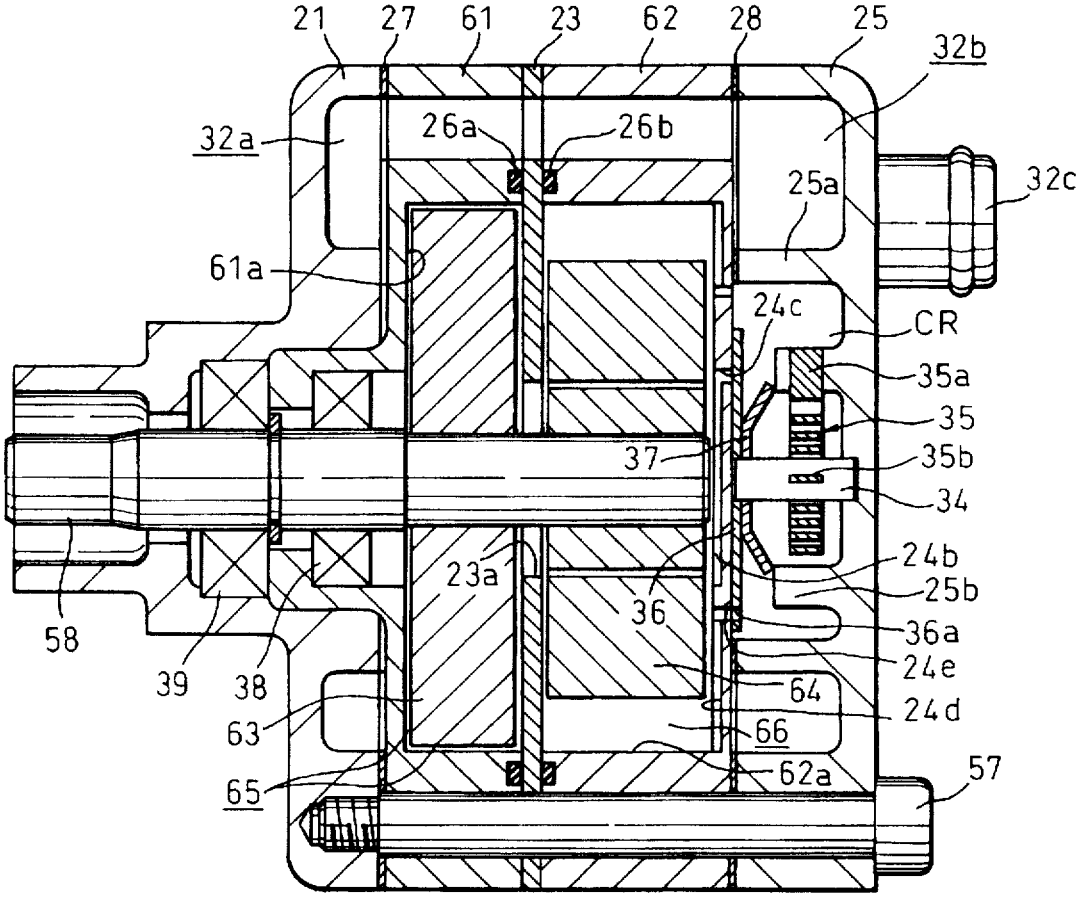
FIG. 4 is a longitudinal cross-sectional view of a viscous fluid type heat generator according to a fourth embodiment of the present invention.

FIG. 4 illustrates the fourth embodiment of the present invention which is substantially similar to the third embodiment of FIG. 3 except for the construction of the first and second heat generating chambers. Namely, in the viscous fluid type heat generator of the fourth embodiment, the first heat generating chamber 65 is defined by a first intermediate plate 61 provided with a circular recess 61*a* formed to have a relatively small axial width, and the second heat generating chamber 66 is defined by a third intermediate plate 62 provided with a circular recess 62*a* formed to have a large axial width. Thus, the first rotor element 63 has a relatively small axial width, but the second rotor element 64 has a large axial width.

Since the viscous fluid type heat generator of the fourth embodiment is provided with the second heat generating chamber 66 formed as a heat-generating-performance variable chamber, and a heat-generating-performance changing unit including a bimetal-coil-spring 35 acting as a valve actuator of a rotary valve 36, the heat generator of the fourth embodiment can adjustably change heat-generating-performance thereof in response to a change in requirement for heating function of the automobile heating system in which the heat generator is incorporated.

It should be understood that the heat-generating-performance of the viscous fluid type heat generator of the fourth embodiment of FIG. 4 is substantially similar to that of the heat generator of the third embodiment of FIG. 3.

From the foregoing description of the first through fourth embodiments of the present invention, it will be understood that, in accordance with the present invention, a viscous fluid type heat generator can exhibit heat-generating-performance which can be varied depending on a change in requirement for heating function of a heating system in which the viscous fluid type heat generator is incorporated, without causing an increase in the production cost of the heat generator.

It should be understood that many and various modifications and variations will occur to persons skilled in the art without departing from the spirit and scope of the present invention as defined by the accompanying claims. For example, when the heat generator is incorporated into an automobile heating system, the heat exchanging liquid used for receiving heat from the heat generating chambers may preferably be a cooling water of an automobile engine. However, the heat exchanging liquid may be a suitable different liquid such as an oil. Further, the first and second heat generating chambers may be isolated from one another by eliminating the central through-bore 23*a* of the illustrated embodiments.

What we claim:

1. A viscous fluid type heat generator comprising:

a housing assembly defining therein, a heat generating chamber for permitting heat to be generated therein, and a heat receiving chamber arranged adjacent to the heat generating chamber for permitting a heat exchanging fluid to circulate therethrough to thereby receive heat from said heat generating chamber;

a drive shaft supported, via a bearing device, by said housing assembly to be rotatable about an axis of rotation thereof;

at least one partition plate dividing the heat generating chamber into at least two separate heat generating component chambers juxtaposed in a direction parallel with the axis of rotation of the drive shaft, each of said heat generating component chambers having inner wall thereof;

at least two rotor elements coaxially mounted on said drive shaft for rotation together therewith, one of said rotor elements being arranged in each of said heat generating component chambers of said heat generating chamber and having outer faces defining spaces between the outer faces of said each rotor element and said inner wall of said each heat generating component chambers;

a viscous fluid confined in said spaces between the outer faces of said each rotor element and said inner wall of said each heat generating component chamber so as to be subjected to a shearing action generating the heat therein during the rotation of said each rotor element, said at least two rotor elements being made different in size from one another to thereby exhibit different heat-generating-performances.

2. A viscous fluid type heat generator according to claim 1, wherein said at least two rotor elements mounted coaxially on said drive shaft have outer diameters different from one another so that said outer faces of said respective rotor elements apply, to the viscous fluid in said respective heat generating component chambers, shearing actions different from one another.

3. A viscous fluid type heat generator according to claim 1, wherein said at least two rotor elements mounted coaxially on said drive shaft have axial widths different from one another so that said respective rotor elements apply, to the viscous fluid in said respective heat generating component chambers, shearing actions different from one another.

4. A viscous fluid type heat generator according to claim 1, wherein one of said at least two separate heat generating component chambers is formed as a heat-generating-performance variable chamber, said heat-generating-performance variable chamber being provided with a heat-generating-performance changing unit including a control chamber arranged adjacent to said heat-generating-performance variable chamber and fluidly communicating with a central region of said heat-generating-performance variable chamber so as to receive a given amount of the viscous fluid from said heat-generating-performance variable chamber under the Weissenberg Effect when the heat-generating-performance of said viscous fluid type heat generator is to be reduced.

5. A viscous fluid type heat generator according to claim 4, wherein said control chamber further communicates with said heat-generating-performance variable chamber so as to supply said given amount of the viscous fluid therefrom into said heat-generating-performance variable chamber.

6. A viscous fluid type heat generator according to claim 1, wherein said heat-generating-performance changing unit includes a thermo-sensitive actuating mechanism for controlling a fluid communication between said heat-generating-performance variable chamber and said control chamber in response to a change in the temperature of the viscous fluid within said control chamber from a predetermined reference temperature.

7. A viscous fluid type heat generator according to claim 6, wherein said thermo-sensitive actuating mechanism comprises a bimetal-actuated rotary valve which controls the fluid communication between said heat-generating-performance variable chamber and said control chamber.

8. A viscous fluid type heat generator according to claim 4, wherein said rotor element arranged within said heat-generating-performance variable chamber has a diameter smaller than that of the rotor element arranged within the other heat generating component chambers.

9. A viscous fluid type heat generator according to claim 1, wherein said housing assembly includes front and rear housing elements axially spaced apart from each another, and a plurality of intermediate plate elements arranged to be juxtaposed to one another between said front and rear housing elements, said front and rear housing elements and said plurality of intermediate plate elements being axially combined together so as to define said at least two heat generating chambers and said heat receiving chambers.

10. A viscous fluid type heat generator according to claim 9, wherein said heat receiving chamber includes first receiving chamber defined within said front housing element and a second heat receiving chamber defined within said rear housing element, said first and second heat receiving chamber being fluidly communicated with one another so as to permit the heat exchanging liquid to flow through said first and second heat receiving chambers, said second heat receiving chamber having an inlet port through which the heat exchanging liquid flows into said first and second heat receiving chambers, and an outlet port through which the heat exchanging liquid to flow out of said first and second heat receiving chambers.

11. A viscous fluid type heat generator according to claim 1, wherein said drive shaft is provided with a transmission unit mounted thereon so as to be connected to a rotation drive source.

12. A viscous fluid type heat generator according to claim 11, wherein said rotation drive source is an automobile engine, and wherein said viscous fluid type heat generator is incorporated into a heating system of an automobile.

* * * * *